US006780121B2

(12) United States Patent
Herber

(10) Patent No.: US 6,780,121 B2
(45) Date of Patent: Aug. 24, 2004

(54) GOLF CLUB HEAD CONSTRUCTION

(76) Inventor: Paul J. Herber, 2060 White Birch Dr., Vista, CA (US) 92083

( * ) Notice: Subject to any disclaimer, the term of this patent is extended or adjusted under 35 U.S.C. 154(b) by 0 days.

(21) Appl. No.: 10/237,222

(22) Filed: Sep. 9, 2002

(65) Prior Publication Data

US 2004/0048684 A1 Mar. 11, 2004

(51) Int. Cl.[7] ..... A63B 69/36; A63B 53/04

(52) U.S. Cl. ..... 473/242; 473/328; 473/244; 473/248

(58) Field of Search ..... 473/244, 248, 473/324, 327, 328, 349, 219, 228, 238, 242; D21/752, 759

(56) References Cited

U.S. PATENT DOCUMENTS

| | | | | | |
|---|---|---|---|---|---|
| D44,457 | S | | 8/1913 | Taylor | |
| 1,089,881 | A | | 3/1914 | Taylor | |
| 1,128,288 | A | | 2/1915 | Churchill | |
| 1,531,821 | A | * | 3/1925 | Scott | 473/327 |
| 1,669,482 | A | | 8/1928 | Miller | |
| 2,255,332 | A | * | 9/1941 | Russel | 473/328 |
| 3,068,011 | A | | 12/1962 | Sano | |
| 3,761,095 | A | | 9/1973 | Thompson | |
| 3,830,503 | A | | 8/1974 | Consoli | |
| 4,065,133 | A | | 12/1977 | Gordos | |
| 4,319,752 | A | | 3/1982 | Thompson | |
| 4,332,388 | A | | 6/1982 | Crow | |
| D266,344 | S | * | 9/1982 | Duclos | D21/752 |
| D311,763 | S | | 10/1990 | Antonious | |
| D326,886 | S | | 6/1992 | Sun | |
| 5,213,329 | A | | 5/1993 | Okumoto | |
| 5,280,911 | A | | 1/1994 | Katayama | |
| 5,286,027 | A | * | 2/1994 | Koumarianos | 473/328 |
| 5,390,924 | A | | 2/1995 | Antonious | |
| 5,456,469 | A | | 10/1995 | MacDougall | |
| 5,464,217 | A | * | 11/1995 | Shenoha et al. | 473/350 |
| 5,497,995 | A | | 3/1996 | Swisshelm | |
| 5,524,890 | A | * | 6/1996 | Kim et al. | 473/242 |
| D371,816 | S | | 7/1996 | Yoshioka | |
| 5,544,884 | A | | 8/1996 | Hardman | |
| 5,762,566 | A | | 6/1998 | King | |
| D398,681 | S | | 9/1998 | Galy | |
| 5,989,134 | A | * | 11/1999 | Antonious | 473/327 |
| D435,075 | S | * | 12/2000 | Ota | D21/759 |
| D461,865 | S | * | 8/2002 | Nagai et al. | D21/759 |
| 2002/0042305 | A1 | | 4/2002 | Otogoro | |

* cited by examiner

*Primary Examiner*—Sebastiano Passaniti
(74) *Attorney, Agent, or Firm*—Pillsbury Winthrop LLP

(57) ABSTRACT

A golf club head (10) of the wood variety includes a first, second and third spaced apart guide fins (20, 22, 24) arranged from the hosel end of the head portion (12) to the opposite tip end. The first fin (20) extending along the lower and rear surfaces of the head portion is orthogonal to the ball striking surface (16). The second fin (22) on the hosel curved end wall extends angularly toward the player and angularly to the first fin. The third fin (24) is located on the tip (38) end wall extending downwardly and outwardly from the head portion. All three fins have respective maximum extension points (30, 36, 42) such that the club head can rest on these points on a flat surface spacing the major lower head portion surface from flat surface.

6 Claims, 2 Drawing Sheets

GOLF CLUB HEAD CONSTRUCTION

BACKGROUND

1. Field of the Invention

The present invention relates generally to a golf club head, and, more particularly, to a golf club head of the so-called "wood" variety providing improved ball striking prospects over a wide range of ball lie situations.

2. Description of Related Art

In the game of golf, the ball typically is hit on each hole onto the fairway (closely clipped grass) or into what is termed the "rough" adjacent the fairway where the grass is longer and may be mixed with all sorts weeds, rocks and other foreign objects. Also, according to the rules of golf the ball is played where it lies (i.e., where it was hit to) and cannot usually be moved to improve the lie without penalty. Still further, the slope of the ground can be found to vary considerably from one location to another even though the locations are quite close to each other. All of these various factors, taken individually or collectively, can make any given ball lie difficult to be reliably struck with a golf club so that reasonable direction and flight distance are achieved. Moreover, the longer the desired flight for the ball being struck in a bad lie, the poorer the prospects of achievement with standard clubs especially when using the longer fairway woods (e.g., numbers 3, 4 and 5 woods).

There have been approaches made in the past to provide optimum results to someone having a sloping lie, the ball is located down within grass, or the lie includes a hard smooth surface. Although the number of bad lie possibilities is practically infinite, a usual bad lie encountered by a player at least once per round, is to find the ball buried down within grass and still have a long way to the green. It is this kind of shot that the present invention achieves its most success in both reliably getting the ball up and out of the grass and moving it a substantial distance.

SUMMARY OF THE INVENTION

It is a primary object and aim of the present invention to provide a golf club head of the wood variety that enhances the reliability of striking a ball situated in a less than good lie.

Another object is the provision of a golf club head as in the previous object which moves through grass during swinging of the club with a minimum of twisting or yanking of the club by the grass.

Yet another object is the provision of guides on the club head that reduce the tendency for the club to dig into the ground during an errant swing.

Still another object as in the previous object is the provision of a number of guide fins which serve to maintain the club head at a relatively constant angular plane to the ground as the club head is swung through a ground-based ball.

BRIEF DESCRIPTION OF THE DRAWING

These and other aspects of the present invention will become more readily apparent upon reference to the following detailed description and upon reviewing the attached drawings, in which.

DESCRIPTION OF A PREFERRED EMBODIMENT

Figure 1:
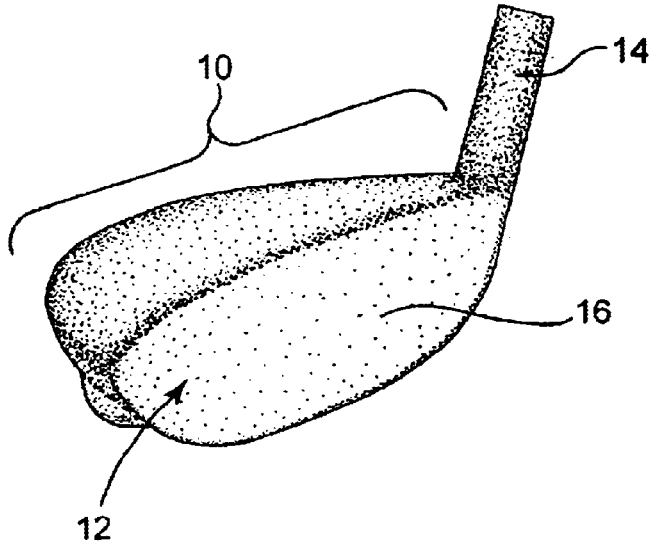
FIG. 1 is a perspective view of golf club head of the invention.
Figure 2:
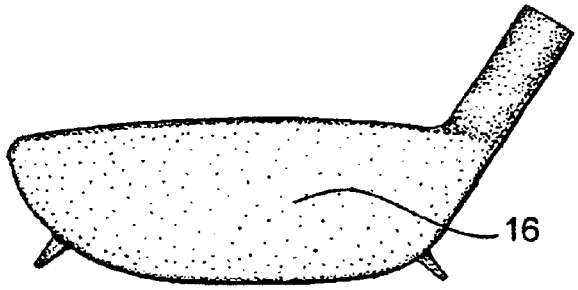
FIG. 2 is a front elevation.
Figure 3:
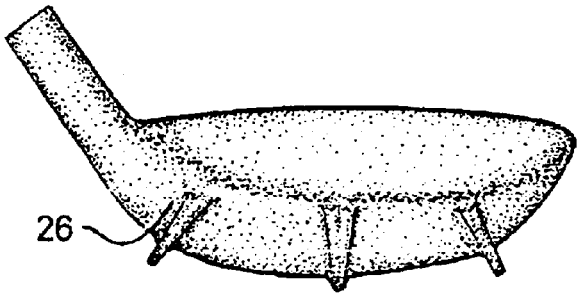
FIG. 3 is a rear elevation.
Figure 4:
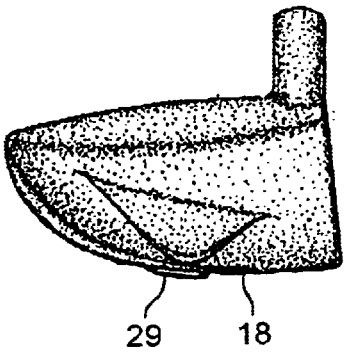
FIG. 4 is a left end elevation.
Figure 6:
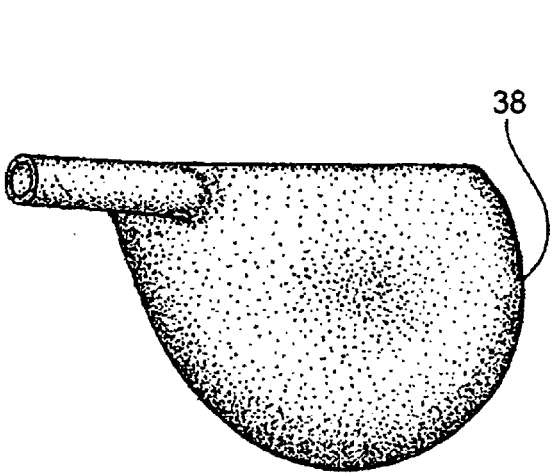
FIG. 6 is a top plan view.

For the ensuing description of the invention reference is now made tp the drawings. In its major aspects, the club head 10 of the invention is of the so-called "wood" category having a head portion 12 with a unitary hosel 14 for connection, in turn, to a club shaft (not shown). The head portion 12 has ball striking surface 16 and a bottom surface 18 adapted for resting or near-resting deployment with the ground when preparing to strike a ball. As described to this point, the head portion and attached hosel are of conventional construction and although referred to as a "wood" club, they are presently usually made of metal and for that reason are frequently referred as a "metal woods".

Figure 7:
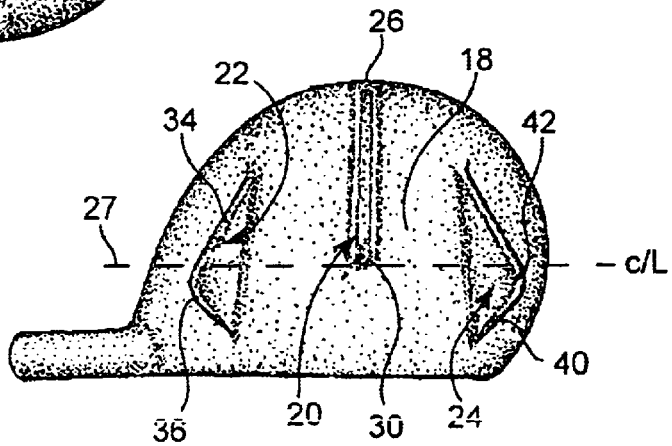
FIG. 7 is a bottom plan view.

With reference now to FIGS. 2, 3, 4, 5 and 7, it is seen that first, second and third guide fins 20, 22 and 24 are integral with the bottom and upwardly sloping side walls of the head portion as will be more particularly described. The first guide fin 20 is generally flat and planar with an edge continuously unitarily secured to the bottom surface 18 and upwardly sloping rear surface 26 of the head portion. The plane of the fin 20 is arranged at approximately 90-degrees to the ball striking surface 16 and has one end terminating at about the front to back centerline 27 of the bottom surface and the opposite end terminating at the juncture of the head portion top surface 28 and sloping rear surface 26 (FIG. 7). As shown best in FIG. 4, the outwardly and downwardly directed edge of fin 20 is convexly curved away from the bottom surface 18 with a lowermost point 29 of extension away from the bottom surface being located just rearwardly of the centerline 27.

Figure 5:
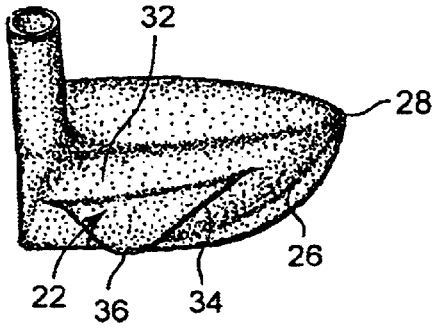
FIG. 5 is a right end elevation.

The second fin 22 is elongate and continuously interconnected with the head portion 12 on a curved end wall 32 extending from the hosel to the bottom surface 18 spaced away from the hosel toward the head portion. The location at the curved end wall 32 represents a first end surface. More particularly, the second fin has an outer edge 34 which extends along a line of increasing angle with respect to the first fin on moving from the rear surface 26 toward the ball striking surface. Still further, the second fin outer edge 34 has a point 36 of maximum extension from the head portion surface 32 and beyond the bottom surface 18 (FIG. 5).

The third fin 24 is constructed very much like the second fin only located on the head portion closely adjacent the outer tip 38. The location at the outer tip 38 represents a second end surface. It is seen in FIG. 7 that the outer and downwardly facing edge 40 of the third fin extends at an increasing angle on moving from the rear surface 26 the ball striking surface 16. Also, the maximum extension point 42 is beyond the head portion bottom surface.

It is important to note that the lowest point 30 of the first fin and maximum extension points 36 and 42, respectively, of the second and third fins lie in a plane so that all the maximum points can be placed in contact with a flat planar surface without the head portion 12 itself contacting the plane. Thus, the fins are convexly curved in a plane free from contact with the head portion. The second and third fins are further canted with respect to each other and the first fin as viewed upwardly onto the bottom surface. Moreover, the second and third fins have convexly curved parts both located on a straight line located between the ball striking surface and the convexly curved part of the first fin. This is advantageous in aiding the club head portion to be spaced a slight amount from the ground during a swing even where the lie conditions are not the best.

As an example of use, assume that the ball is nestled down within a substantial height of grass (e.g., 2–4 inches). The two typical bad results obtained with a conventional fairway wood in this situation are: (1) the club head gets stuck in the grass before it reaches the ball and twisted or yanked badly off line resulting in the ball going in the wrong direction and not very far; or (2) to avoid the first problem the player swings in a steeper plane higher and on hitting the ball either fails to get it up at all or actually hits behind the ball resulting in a high short hit ("sky" shot). On using a club as described herein, however, the guiding action of the fins tend on moving through the grass to reduce yanking or twisting of the club face off line thereby improving ball hitting prospects. Also, because the player can now feel the club head glide through the grass, there is a marked decrease in the tendency of the player to hit down behind the ball.

Another type of bad lie is a "close" one where the ball rests on bare ground which requires the ball to be hit more precisely for good results. If a conventional fairway wood is used having a large relatively flat bottom, anything but a precise hit can result in totally unpleasant results. When using the described club of this invention, however, by having the major bottom surface area spaced from the ground, even if the there is considerable contact force of the fins onto the ground the odds are improved that the club will continue through the ball.

Although the invention is described in connection with a preferred embodiment, it is to be understood that those skilled in the appertaining art may suggest modifications that come within the spirit of the invention as described and within the ambit of the appended claims.

What I claim is:

1. A golf club head of the wood variety, comprising:

a club head portion having a ball striking surface, a top surface, a bottom surface, first and second end surfaces, a rear surface and a hosel extending upwardly from the top surface adjacent the first end surface;

a first guide fin of generally straightline configuration having a first edge unitarily secured to the head portion bottom surface, a second edge opposite to the first edge portion extending outwardly away from the bottom surface and aligned at approximately 90-degrees to the ball striking face, said second edge having a convexly curved part extending away from the bottom surface a greater distance than the remainder of the second edge;

a second guide fin secured to the head portion first end surface and having a convexly curved outwardly directed part extending away from the first end surface and extending generally from the head portion rear surface toward the ball striking surface; and a third guide fin secured to the head portion second end surface and extending outwardly away from said second end surface between the rear surface and the ball striking surface, said fin having a convexly curved part extending at a greater distance away from the second end surface than the remainder of the third guide fin.

2. A golf club head as in claim 1, in which the first, second, and third fins have convexly curved parts lying in a plane free from contact with the head portion.

3. A golf club head as in claim 1, in which the first fin continuously interconnects with the head portion outer surface extending from a first termination on the head portion rear surface to a second termination located on the bottom surface approximately one-half the distance from the ball striking surface to the rear surface, said first fin convexly curved part being located rearwardly adjacent the second termination.

4. A golf head as in claim 3, in which the second and third fins have convexly curved parts located on a straight line located between the ball striking surface and the convexly curved part of the first fin.

5. A golf club head as in claim 1, in which the first fin extends generally at 90-degrees to the head portion top surface and bottom surface, and said second and third fins are canted downwardly away from each other and the first fin as viewed from the ball striking surface toward the rear surface, and the second and third fins are further canted with respect to each other and the first fin as viewed upwardly onto the bottom surface.

6. A golf club head as in claim 5, in which the lateral space between the second and third fins increases to a maximum adjacent the ball striking surface.

* * * * *